US011578725B2

(12) United States Patent
Mahure

(10) Patent No.: US 11,578,725 B2
(45) Date of Patent: Feb. 14, 2023

(54) COMPRESSOR HAVING MUFFLER PLATE

(71) Applicant: Emerson Climate Technologies, Inc., Sidney, OH (US)

(72) Inventor: Yogesh S. Mahure, Pune (IN)

(73) Assignee: Emerson Climate Technologies, Inc., Sidney, OH (US)

( * ) Notice: Subject to any disclaimer, the term of this patent is extended or adjusted under 35 U.S.C. 154(b) by 287 days.

(21) Appl. No.: 15/930,616

(22) Filed: May 13, 2020

(65) Prior Publication Data

US 2021/0355944 A1 Nov. 18, 2021

(51) Int. Cl.

| | |
|---|---|
| ***F04C 29/06*** | (2006.01) |
| ***F04C 18/02*** | (2006.01) |
| ***F04C 27/00*** | (2006.01) |

(52) U.S. Cl.

CPC ..... *F04C 29/065* (2013.01); *F04C 18/0215* (2013.01); *F04C 27/005* (2013.01); *F04C 27/008* (2013.01); *F04C 29/068* (2013.01)

(58) Field of Classification Search

CPC .. F04C 29/065; F04C 18/0215; F04C 27/005; F04C 27/008; F04C 29/068; F04C 28/26

See application file for complete search history.

(56) References Cited

U.S. PATENT DOCUMENTS

| | | | |
|---|---|---|---|
| 2,294,105 | A | 8/1942 | Wallgren |
| 2,592,082 | A | 4/1952 | Trumpler |
| 2,867,462 | A | 1/1959 | Nielsen |
| 3,306,683 | A | 2/1967 | Deuring |
| 3,511,512 | A | 5/1970 | Wheelock |
| 3,600,114 | A | 8/1971 | Dvorak et al. |

(Continued)

FOREIGN PATENT DOCUMENTS

| | | | |
|---|---|---|---|
| CN | 1060699 | A | 4/1992 |
| CN | 1113547 | A | 12/1995 |

(Continued)

OTHER PUBLICATIONS

Definition of Arch from the Merriam-Webster Dictionary on the internet (https://www.merriam-webster.com/dictionary/arch) (Year: 2022).*

(Continued)

*Primary Examiner* — Dominick L Plakkoottam
*Assistant Examiner* — Paul W Thiede
(74) *Attorney, Agent, or Firm* — Harness, Dickey & Pierce, P.L.C.

(57) ABSTRACT

A compressor includes a shell assembly, a muffler plate and a compression mechanism. The shell assembly has a suction chamber and a discharge chamber. The muffler plate is disposed within the shell assembly and separates the suction chamber from the discharge chamber. The muffler plate includes a hub having a circumferentially extending inner portion and a circumferentially extending intermediate portion. The circumferentially extending inner portion defines a discharge passage extending therethrough. The circumferentially extending intermediate portion has a slot formed in a surface thereof. The slot extends at least partially around the circumferentially extending intermediate portion. The compression mechanism is disposed within the suction chamber and provides working fluid to the discharge chamber via the discharge passage of muffler plate.

20 Claims, 5 Drawing Sheets

(56) References Cited

U.S. PATENT DOCUMENTS

| | | | | |
|---|---|---|---|---|
| 3,707,852 | A | 1/1973 | Burckhardt et al. | |
| 4,116,452 | A | 9/1978 | Schanz | |
| 4,596,520 | A | 6/1986 | Arata et al. | |
| 4,655,462 | A | 4/1987 | Balsells | |
| 4,669,737 | A | 6/1987 | Diffenderfer | |
| 4,869,514 | A | 9/1989 | Bogdanovic | |
| 4,877,382 | A | 10/1989 | Caillat et al. | |
| 4,940,080 | A | 7/1990 | Reeves et al. | |
| 4,993,928 | A | 2/1991 | Fraser, Jr. | |
| 5,105,879 | A | 4/1992 | Ross | |
| 5,156,539 | A | 10/1992 | Anderson et al. | |
| 5,311,748 | A | 5/1994 | Bahel et al. | |
| 5,342,183 | A | 8/1994 | Rafalovich et al. | |
| 5,407,335 | A | 4/1995 | Caillat et al. | |
| 5,435,707 | A | 7/1995 | Hirano et al. | |
| 5,447,418 | A | 9/1995 | Takeda et al. | |
| 5,447,420 | A | 9/1995 | Caillat et al. | |
| 5,494,422 | A | 2/1996 | Ukai et al. | |
| RE35,216 | E | 4/1996 | Anderson et al. | |
| 5,503,542 | A | 4/1996 | Grassbaugh et al. | |
| 5,540,572 | A | 7/1996 | Park et al. | |
| 5,562,435 | A | 10/1996 | Cho et al. | |
| 5,588,820 | A | 12/1996 | Hill et al. | |
| 5,607,288 | A | 3/1997 | Wallis et al. | |
| 5,613,841 | A | 3/1997 | Bass et al. | |
| 5,707,210 | A | 1/1998 | Ramsey et al. | |
| 5,800,141 | A | 9/1998 | Ceylan et al. | |
| 5,803,716 | A | 9/1998 | Wallis et al. | |
| 5,921,761 | A | 7/1999 | Eckels | |
| 6,027,321 | A | 2/2000 | Shim et al. | |
| 6,048,184 | A | 4/2000 | Chang et al. | |
| 6,059,549 | A | 5/2000 | Tarng et al. | |
| 6,077,057 | A | 6/2000 | Hugenroth et al. | |
| 6,095,765 | A | 8/2000 | Khalifa | |
| 6,135,739 | A | 10/2000 | Ogawa et al. | |
| 6,146,119 | A | 11/2000 | Bush et al. | |
| 6,164,660 | A | 12/2000 | Goodman | |
| 6,171,088 | B1 | 1/2001 | Sun et al. | |
| 6,267,565 | B1 * | 7/2001 | Seibel | F04C 28/28 62/196.3 |
| 6,419,457 | B1 | 7/2002 | Seibel et al. | |
| 6,631,685 | B2 | 10/2003 | Hewitt | |
| 6,821,092 | B1 | 11/2004 | Gehret et al. | |
| 6,913,448 | B2 | 7/2005 | Liang et al. | |
| 6,984,115 | B1 | 1/2006 | Tarng et al. | |
| 7,070,401 | B2 | 7/2006 | Clendenin et al. | |
| 7,140,851 | B2 | 11/2006 | Tarng | |
| 7,338,265 | B2 * | 3/2008 | Grassbaugh | F04C 28/265 418/270 |
| 7,491,045 | B2 | 2/2009 | Masuda | |
| 7,543,822 | B2 | 6/2009 | Grimanis et al. | |
| 7,568,897 | B2 * | 8/2009 | Grassbaugh | F04C 28/265 277/552 |
| 7,611,345 | B2 | 11/2009 | Huang et al. | |
| 8,287,257 | B2 | 10/2012 | Dunaevsky | |
| 8,932,036 | B2 | 1/2015 | Monnier et al. | |
| 9,121,276 | B2 | 9/2015 | Heidecker et al. | |
| 10,975,868 | B2 | 4/2021 | Jorwekar et al. | |
| 2002/0026806 | A1 | 3/2002 | Tsuboe et al. | |
| 2002/0119063 | A1 | 8/2002 | Morozumi | |
| 2003/0012659 | A1 | 1/2003 | Seibel et al. | |
| 2003/0063982 | A1 | 4/2003 | Pham | |
| 2004/0071571 | A1 | 4/2004 | Uchida et al. | |
| 2004/0136854 | A1 | 7/2004 | Kimura et al. | |
| 2005/0123428 | A1 | 6/2005 | Uchida et al. | |
| 2005/0142017 | A1 | 6/2005 | Liang et al. | |
| 2005/0265880 | A1 | 12/2005 | Chang et al. | |
| 2006/0198748 | A1 | 9/2006 | Grassbaugh et al. | |
| 2007/0036661 | A1 | 2/2007 | Stover | |
| 2007/0224071 | A1 | 9/2007 | Wang | |
| 2008/0101972 | A1 | 5/2008 | Tarng et al. | |
| 2008/0159895 | A1 | 7/2008 | Huang et al. | |
| 2008/0175737 | A1 | 7/2008 | Grassbaugh et al. | |
| 2009/0060767 | A1 | 3/2009 | Zamudio | |
| 2009/0098001 | A1 | 4/2009 | Ni | |
| 2009/0169405 | A1 | 7/2009 | Suefuji et al. | |
| 2009/0185926 | A1 | 7/2009 | Bush | |
| 2009/0185935 | A1 | 7/2009 | Seibel et al. | |
| 2009/0246059 | A1 | 10/2009 | Nakamura et al. | |
| 2010/0254841 | A1 | 10/2010 | Akel et al. | |
| 2010/0303659 | A1 | 12/2010 | Stover et al. | |
| 2011/0293456 | A1 | 12/2011 | Seibel et al. | |
| 2012/0148433 | A1 | 6/2012 | Liang et al. | |
| 2012/0258002 | A1 | 10/2012 | Rose | |
| 2013/0078128 | A1 | 3/2013 | Akei | |
| 2014/0023541 | A1 | 1/2014 | Heidecker et al. | |
| 2014/0271306 | A1 * | 9/2014 | Kim | F04C 28/26 418/55.4 |
| 2015/0316055 | A1 | 11/2015 | Jin et al. | |
| 2015/0316058 | A1 | 11/2015 | Jin et al. | |
| 2016/0025094 | A1 * | 1/2016 | Ignatiev | F04C 18/0215 417/410.5 |
| 2019/0010944 | A1 | 1/2019 | Jorwekar et al. | |
| 2019/0178250 | A1 | 6/2019 | DeFord et al. | |

FOREIGN PATENT DOCUMENTS

| | | | |
|---|---|---|---|
| CN | 1184894 | A | 6/1998 |
| CN | 1286358 | A | 3/2001 |
| CN | 1415913 | A | 5/2003 |
| CN | 1576605 | A | 2/2005 |
| CN | 1828022 | A | 9/2006 |
| CN | 101046204 | A | 10/2007 |
| CN | 102449313 | A | 5/2012 |
| CN | 203214294 | U | 9/2013 |
| CN | 104061157 | A | 9/2014 |
| CN | 209180006 | U | 7/2019 |
| EP | 0482209 | A1 | 4/1992 |
| EP | 0747598 | A2 | 12/1996 |
| EP | 1698784 | B1 | 3/2013 |
| JP | H05149269 | A | 6/1993 |
| JP | H06346871 | A | 12/1994 |
| JP | H08296572 | A | 11/1996 |
| KR | 20020030018 | A | 4/2002 |
| KR | 20180065340 | A | 6/2018 |
| RU | 2064050 | C1 | 7/1996 |
| WO | WO-2009035640 | A1 | 3/2009 |
| WO | WO-2016049464 | A1 | 3/2016 |

OTHER PUBLICATIONS

U.S. Appl. No. 16/864,987, filed May 1, 2020, James W. McBean et al..

U.S. Appl. No. 16/883,323, filed May 26, 2020, James A. Schaefer et al.

International Search Report regarding International Application No. PCT/US2011/058128, dated Apr. 10, 2012.

Written Opinion of the International Searching Authority regarding International Application No. PCT/US2011/058128, dated Apr. 10, 2012.

Office Action regarding U.S. Appl. No. 13/283,097, dated Jan. 30, 2014.

Office Action regarding Russian Patent Application No. 2013124425, dated Jun. 9, 2014. Translation provided by Gowlings International Inc.

Office Action regarding U.S. Appl. No. 13/283,097, dated Jul. 9, 2014.

Office Action regarding Chinese Patent Application No. 201180052695.2, dated Feb. 2, 2015. Translation provided by Unitalen Attorneys at Law.

Office Action regarding Chinese Patent Application No. 201180052695.2, dated Oct. 9, 2015. Translation provided by Unitalen Attorneys at Law.

Office Action regarding Chinese Patent Application No. 201180052695.2, dated Mar. 17, 2016. Translation provided by Unitalen Attorneys at Law.

Search Report regarding European Patent Application No. 11837109.5, dated Jun. 8, 2016.

Office Action regarding European Patent Application No. 11837109.5, dated Nov. 17, 2017.

(56) References Cited

OTHER PUBLICATIONS

Office Action regarding Chinese Patent Application No. 201610608786.4, dated Jan. 23, 2018. Translation provided by Unitalen Attorneys at Law.
Office Action regarding Indian Patent Application No. 735/MUMNP/2013, dated Jun. 6, 2018.
Office Action regarding Chinese Patent Application No. 201610608786.4, dated Sep. 10, 2018. Translation provided by Unitalen Attorneys at Law.
Office Action regarding Chinese Patent Application No. 201810735714.5, dated Jun. 3, 2019. Translation provided by Unitalen Attorneys at Law.
Office Action regarding European Patent Application No. 11837109.5, dated Jun. 18, 2019.
Office Action regarding Chinese Patent Application No. 201810735714.5, dated Nov. 27, 2019. Translation provided by Unitalen Attorneys at Law.
Office Action regarding Indian Patent Application No. 201721023952, dated Nov. 27, 2019.
Office Action regarding European Patent Application No. 11837109.5, dated Mar. 9, 2020.
Restriction Requirement regarding U.S. Appl. No. 16/025,050, dated Jun. 5, 2020.
Office Action regarding U.S. Appl. No. 16/025,050, dated Jul. 27, 2020.
Office Action regarding Indian Patent Application No. 201824024885, dated Aug. 11, 2020.
International Search Report regarding Application No. PCT/US2021-033899 dated Sep. 6, 2021.
Written Opinion of the ISA regarding Application No. PCT/US2021/033899 dated Sep. 6, 2021.
Non-Final Office Action regarding U.S. Appl. No. 16/883,323 dated Feb. 2, 2022.
Office Action regarding European Patent Application No. 11837109.5, dated Apr. 26, 2021.
International Search Report from the ISA regarding Application No. PCT/US2021/029179 dated Aug. 2, 2021.
Written Opinion of the ISA regarding Application No. PCT/US2021/029179 dated Aug. 2, 2021.
International Search Report and Written Opinion regarding International Application No. PCT/US2021/029179, dated Aug. 2, 2021.
Written Opinion of the ISA regarding Application No. PCT/US2021/032036 dated Aug. 24, 2021.
International Search Report regarding Application No. PCT/US2021/032036 dated Aug. 24, 2021.
CA Notice of Allowance regarding U.S. Appl. No. 16/025,050, dated Dec. 24, 2020.
Non-Final Office Action regarding U.S. Appl. No. 16/864,987 dated Mar. 15, 2022.
International Search Report regarding Application No. PCT/US2022/013142 dated May 3, 2022.
Written Opinion regarding Application No. PCT/US2022/013142 dated May 3, 2022.

* cited by examiner

COMPRESSOR HAVING MUFFLER PLATE

FIELD

The present disclosure relates to a compressor having a muffler plate.

BACKGROUND

This section provides background information related to the present disclosure and is not necessarily prior art.

Heat-pump systems and other working fluid circulation systems include a fluid circuit having an outdoor heat exchanger, an indoor heat exchanger, an expansion device disposed between the indoor and outdoor heat exchangers, and a compressor circulating a working fluid (e.g., refrigerant or carbon dioxide) between the indoor and outdoor heat exchangers. Efficient and reliable operation of the compressor is desirable to ensure that the heat-pump system in which the compressor is installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provide a compressor that includes a shell assembly, a muffler plate and a compression mechanism. The shell assembly has a suction chamber and a discharge chamber. The muffler plate is disposed within the shell assembly and separates the suction chamber from the discharge chamber. The muffler plate includes a hub and a non-arched section at least partially surrounding the hub. The hub having a circumferentially extending inner portion and a circumferentially extending intermediate portion. The circumferentially extending inner portion defines a discharge passage extending therethrough. The circumferentially extending intermediate portion has a slot formed in a surface thereof. The slot extends at least partially around the circumferentially extending intermediate portion. The compression mechanism is disposed within the suction chamber and provides working fluid to the discharge chamber via the discharge passage of muffler plate.

In some configurations of the compressor of the above paragraph, the slot extends around the circumferentially extending intermediate portion between 250 and 320 degrees.

In some configurations of the compressor of any one or more of the above paragraphs, a thickness of the intermediate portion is greater than a thickness of the inner portion.

In some configurations of the compressor of any one or more of the above paragraphs, a sealing member surrounds the discharge passage and is sealingly engaged with a wear ring of the muffler plate. The point of engagement between the sealing member and the wear ring is located radially inwardly relative to the slot.

In some configurations of the compressor of any one or more of the above paragraphs, a sealing member surrounds the discharge passage and is sealingly engaged with a wear ring of the muffler plate. The point of engagement between the sealing member and the wear ring is located between the discharge passage and the slot.

In some configurations of the compressor of any one or more of the above paragraphs, the hub includes a lip extending downwardly from the circumferentially extending inner portion and at least partially defining the discharge passage. The point of engagement between the sealing member and the wear ring is located between the lip and the slot.

In another form, the present disclosure discloses a compressor that includes a shell assembly, a muffler plate, and a compression mechanism. The shell assembly has a suction chamber and a discharge chamber. The muffler plate is disposed within the shell assembly and separates the suction chamber from the discharge chamber. The muffler plate includes a hub having a circumferentially extending intermediate portion and a circumferentially extending outer portion. The circumferentially extending outer portion includes an arched section and a non-arched section. The non-arched section extends at least partially around the circumferentially extending intermediate portion. The compression mechanism is disposed within the suction chamber and provides working fluid to the discharge chamber via a discharge passage of muffler plate.

In some configurations of the compressor of the above paragraph, the non-arched section extends around the circumferentially extending intermediate portion between 250 and 320 degrees.

In some configurations of the compressor of any one or more of the above paragraphs, a thickness of the arched section is greater than a thickness of the circumferentially extending intermediate portion.

In some configurations of the compressor of any one or more of the above paragraphs, the muffler plates includes a lobe extending from the circumferentially extending outer portion. The lobe has opposing outer walls and an upper wall.

In some configurations of the compressor of any one or more of the above paragraphs, the arched section is positioned between the opposing outer walls.

In some configurations of the compressor of any one or more of the above paragraphs, the upper wall is flat. The arched section is positioned adjacent the flat upper wall.

In some configurations of the compressor of any one or more of the above paragraphs, a slot is formed in a surface of the circumferentially extending intermediate portion. The slot extends at least partially around the circumferentially extending intermediate portion.

In some configurations of the compressor of any one or more of the above paragraphs, the non-arched section includes a flat upper surface.

In some configurations of the compressor of any one or more of the above paragraphs, the non-arched section includes a flat upper surface that is located a distance below an apex of the arched section.

In some configurations of the compressor of any one or more of the above paragraphs, the discharge passage extends through a circumferentially extending inner portion of the hub. The circumferentially extending intermediate portion is positioned between the circumferentially extending inner portion and the circumferentially extending outer portion.

In yet another form, the present disclosure discloses a compressor that includes a shell assembly, a muffler plate, a sealing member and a compression mechanism. The shell assembly has a suction chamber and a discharge chamber. The muffler plate is disposed within the shell assembly and separates the suction chamber from the discharge chamber. The muffler plate includes a hub having a circumferentially extending inner portion, a circumferentially extending outer portion and a circumferentially extending intermediate portion positioned between the circumferentially extending inner portion and the circumferentially extending outer portion. The circumferentially extending intermediate portion has a slot formed in a surface thereof. The slot extends at least partially around the circumferentially extending intermediate portion. The lobe extends from the circumferentially extending outer portion of the hub. The sealing member surrounds the discharge passage and is sealingly engaged with the muffler plate. The point of engagement between the sealing member and the muffler plate is located radially inwardly relative to the slot. The compression mechanism is disposed within the suction chamber and provides working fluid to the discharge chamber via a discharge passage extending through the circumferentially extending inner portion of the muffler plate.

In some configurations of the compressor of the above paragraph, the lobe includes an upper wall and opposing outer walls and the circumferentially extending outer portion includes an arched section and a non-arched section. The arched section is positioned between the opposing outer walls.

In some configurations of the compressor of any one or more of the above paragraphs, the arched section is positioned between the upper wall and a solid segment of the circumferentially extending intermediate portion that extends the length of the circumferentially extending intermediate portion and the thickness of the circumferentially extending intermediate portion.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
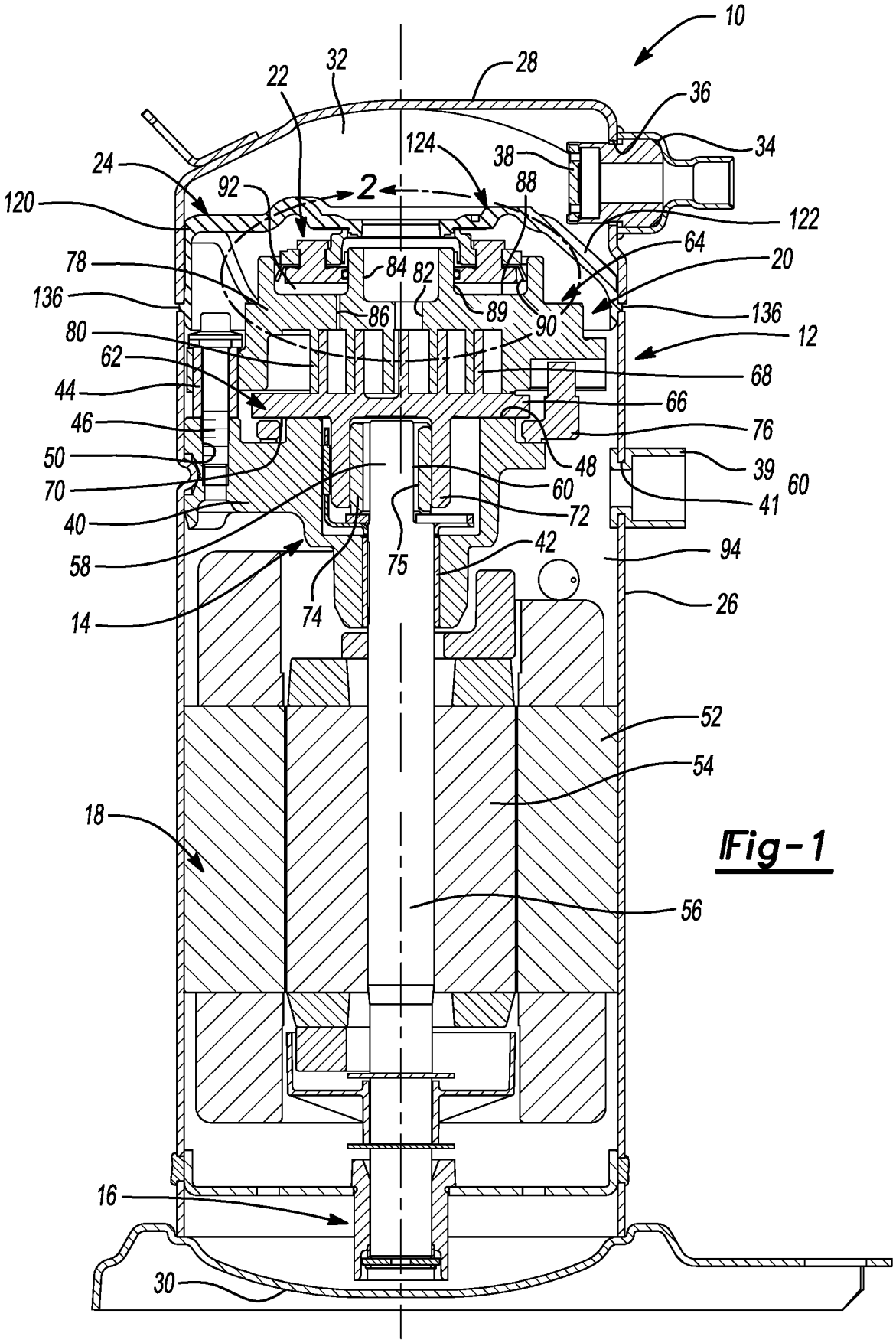
FIG. 1 is a cross-sectional view of a compressor including a muffler plate in accordance with the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As shown in FIG. 1, a compressor 10 is provided that may include a hermetic shell assembly 12, a first bearing housing assembly 14, a second bearing housing assembly 16, a motor assembly 18, a compression mechanism 20, a floating seal assembly 22 and a partition or muffler plate 24.

The shell assembly 12 may form a compressor housing and may include a cylindrical shell 26, an end cap 28 at an upper end thereof, and a base 30 at a lower end thereof. The end cap 28 and the muffler plate 24 may define a discharge chamber 32. A discharge fitting 34 may be attached to the shell assembly 12 at an opening 36 in the end cap 28. A discharge valve assembly 38 may be disposed within the discharge fitting 34 and may generally prevent a reverse flow condition. A suction inlet fitting 39 may be attached to shell assembly 12 at an opening 41.

The first bearing housing assembly 14 may be fixed relative to the shell 26 and may include a main bearing housing 40, a first bearing 42, sleeve guides or bushings 44, and fastener assemblies 46. The main bearing housing 40 may house the first bearing 42 therein and may define an annular flat thrust bearing surface 48 on an axial end surface thereof. The main bearing housing 40 may include apertures 50 extending therethrough and receiving the fastener assemblies 46.

The motor assembly 18 may include a motor stator 52, a rotor 54, and a drive shaft 56. The motor stator 52 may be press fit into the shell 26. The rotor 54 may be press fit on the drive shaft 56 and may transmit rotational power to the drive shaft 56. The drive shaft 56 may be rotatably supported within the first and second bearing housing assemblies 14, 16. The drive shaft 56 may include an eccentric crank pin 58 having a flat 60 thereon.

The compression mechanism 20 may include an orbiting scroll 62 and a non-orbiting scroll 64. The orbiting scroll 62 may include an end plate 66 having a spiral wrap 68 on an upper surface thereof and an annular flat thrust surface 70 on a lower surface. The thrust surface 70 may interface with the annular flat thrust bearing surface 48 on the main bearing housing 40. A cylindrical hub 72 may project downwardly from thrust surface 70 and may include a drive bushing 74 disposed therein. The drive bushing 74 may include an inner bore 75 in which the crank pin 58 is drivingly disposed. The crank pin flat 60 may drivingly engage a flat surface in a portion of the inner bore 75 to provide a radially compliant driving arrangement. An Oldham coupling 76 may be engaged with the orbiting and non-orbiting scrolls 62, 64 to prevent relative rotation therebetween.

The non-orbiting scroll 64 may include an end plate 78 and a spiral wrap 80 projecting downwardly from the end plate 78. The spiral wrap 80 may meshingly engage the spiral wrap 68 of the orbiting scroll 62, thereby creating a series of moving fluid pockets. The fluid pockets defined by the spiral wraps 68, 80 may decrease in volume as they move from a radially outer position (at a suction pressure) to a radially intermediate position (at an intermediate pressure) to a radially inner position (at a discharge pressure) throughout a compression cycle of the compression mechanism 20.

The end plate 78 may include a discharge passage 82, a discharge recess 84, an intermediate passage 86, and an annular recess 88. The discharge passage 82 is in communication with one of the fluid pockets at the radially inner position and allows compressed working fluid (at the discharge pressure) to flow through the discharge recess 84 and into the discharge chamber 32. The intermediate passage 86 may provide communication between one of the fluid pockets at the radially intermediate position and the annular recess 88. The annular recess 88 may encircle the discharge recess 84 and may be substantially concentric therewith. The annular recess 88 may include an inner surface 89 and an outer surface 90.

The annular recess 88 may at least partially receive the seal assembly 22 and may cooperate with the seal assembly 22 to define an axial biasing chamber 92 therebetween. The biasing chamber 92 receives fluid from the fluid pocket in the intermediate position through the intermediate passage 86. A pressure differential between the intermediate-pressure fluid in the biasing chamber 92 and fluid in a suction chamber 94 exerts a net axial biasing force on the non-orbiting scroll 64 urging the non-orbiting scroll 64 toward the orbiting scroll 62. In this manner, the tips of the spiral wrap 80 of the non-orbiting scroll 64 are urged into sealing engagement with the end plate 66 of the orbiting scroll 62 and the end plate 78 of the non-orbiting scroll 64 is urged into sealing engagement with the tips of the spiral wrap 68 of the orbiting scroll 62.

Figure 2:
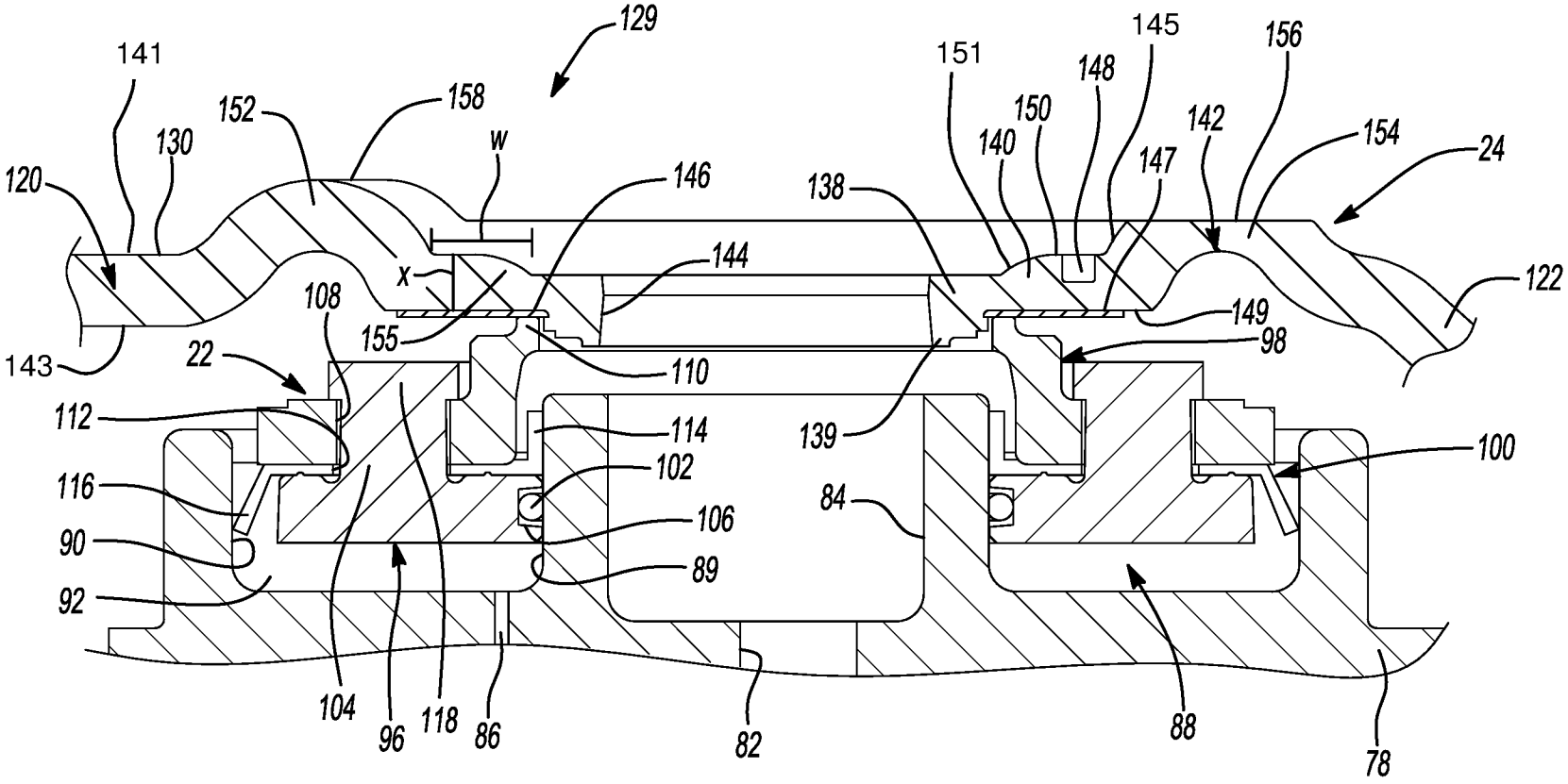
FIG. 2 is a close-up view of the compressor indicated as area 2 in FIG. 1.

With reference to FIG. 2, the seal assembly 22 may include an annular base plate 96, a first annular sealing member 98, a second annular sealing member 100, and a third annular sealing member 102 (e.g., an O-ring). The annular base plate 96 may include a plurality of axially extending projections 104 and an annular groove 106. The annular groove 106 may include a generally rectangular or trapezoidal cross section, for example, and may receive the third annular sealing member 102. The first annular sealing member 98 may include a plurality of apertures 108 and a lip portion 110 that sealingly engages the muffler plate 24. The second annular sealing member 100 may include a plurality of apertures 112, a generally upwardly extending inner portion 114, and a generally outwardly and downwardly extending outer portion 116. The inner portion 114 may sealingly engage the inner surface 89 of the annular recess 88, and the outer portion 116 may sealingly engage the outer surface 90 of the annular recess 88.

Each of the plurality of axially extending projections 104 of the annular base plate 96 engage a corresponding one of the apertures 108 in the first annular sealing member 98 and a corresponding one of the apertures 112 in the second annular sealing member 100. Ends 118 of the projections 104 may be swaged or otherwise deformed to secure the first and second annular sealing members 98, 100 to the annular base plate 96. In some configurations, additional or alternative means may be employed to secure the first annular sealing member 98 to the annular base plate 96, such as threaded fasteners and/or welding, for example.

Figure 7:
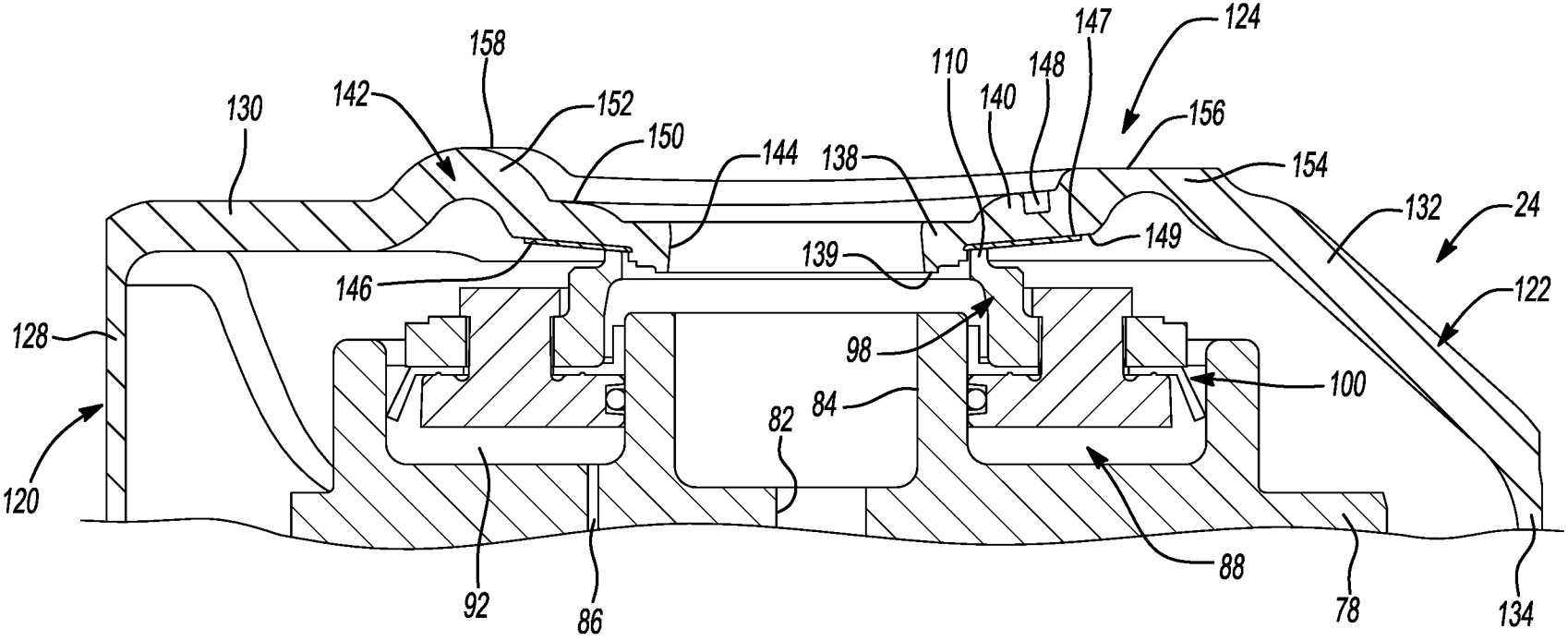
FIG. 7 is a cross-sectional view of the muffler plate after elastic deformation.

As shown in FIG. 1, the muffler plate 24 may be disposed within the shell assembly 12 and may separate the discharge chamber 32 from the suction chamber 94. With reference to FIGS. 1-7, the muffler plate 24 may be a single, unitary component and may include a lobe 120 (FIGS. 3-5 and 7), a wedge 122 and a hub 124. The lobe 120 may extend from the wedge 122 and the hub 124, and may include opposing outer walls 126*a*, 126*b*, an arcuate back wall 128 and a planar upper wall 130. One or more safety devices (e.g., thermally operated disc) may be placed on the planar upper wall 130 of the lobe 120, and may facilitate venting of the discharge chamber 32 when fluid temperatures therein exceed a predetermined threshold, for example. As shown in FIG. 7, the upper wall 130 may have a thickness that is greater than a thickness of the back wall 128.

The wedge 122 may extend from and substantially around the hub 124, and may include a body portion 132 and an end portion 134. The body portion 132 extends downwardly at an angle from the hub 124 to the end portion 134. The end portion 134 extends downwardly from an end of the body portion 132 away from the discharge chamber 32 (i.e., towards the motor assembly 18). The body portion 132 may have a thickness that is greater than a thickness of the end portion 134 and substantially equal to the thickness of the upper wall 130 of the lobe 120. A protrusion 136 may extend radially outwardly from and around the back wall 128 of the lobe 120 and the end portion 134 of the wedge 122, and may be attached (e.g., welded) to the shell 26 of the shell assembly 12.

Figure 3:
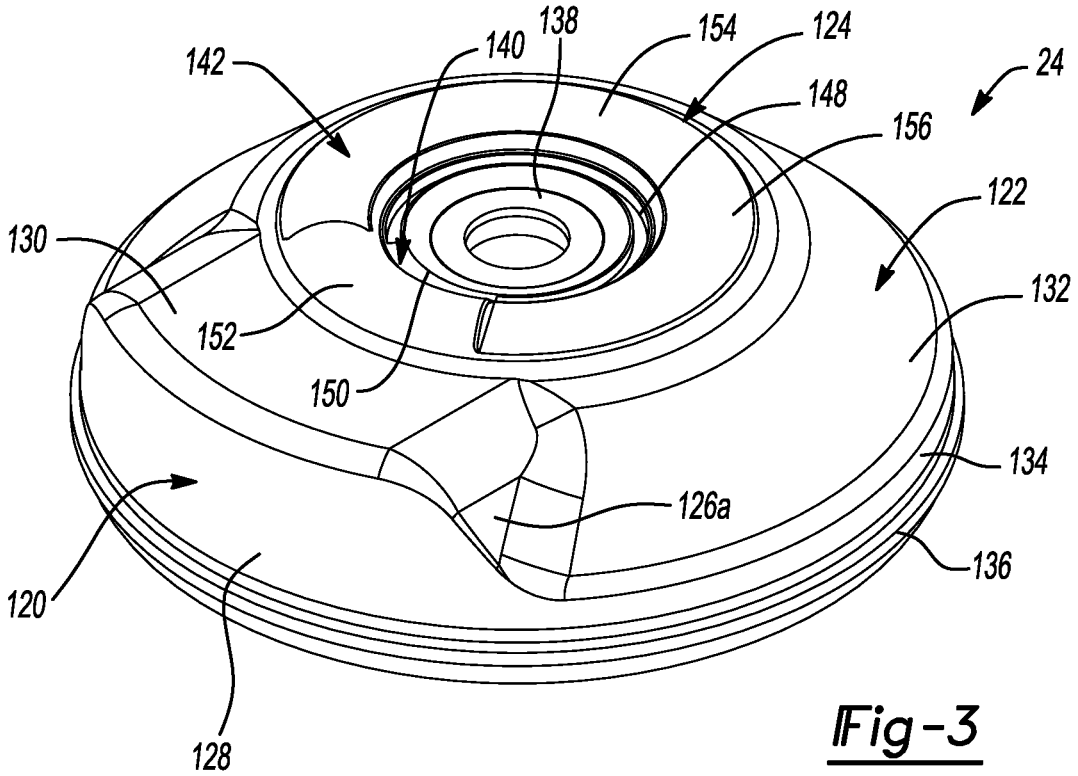
FIG. 3 is a perspective view of the muffler plate of FIG. 1.
Figure 4:
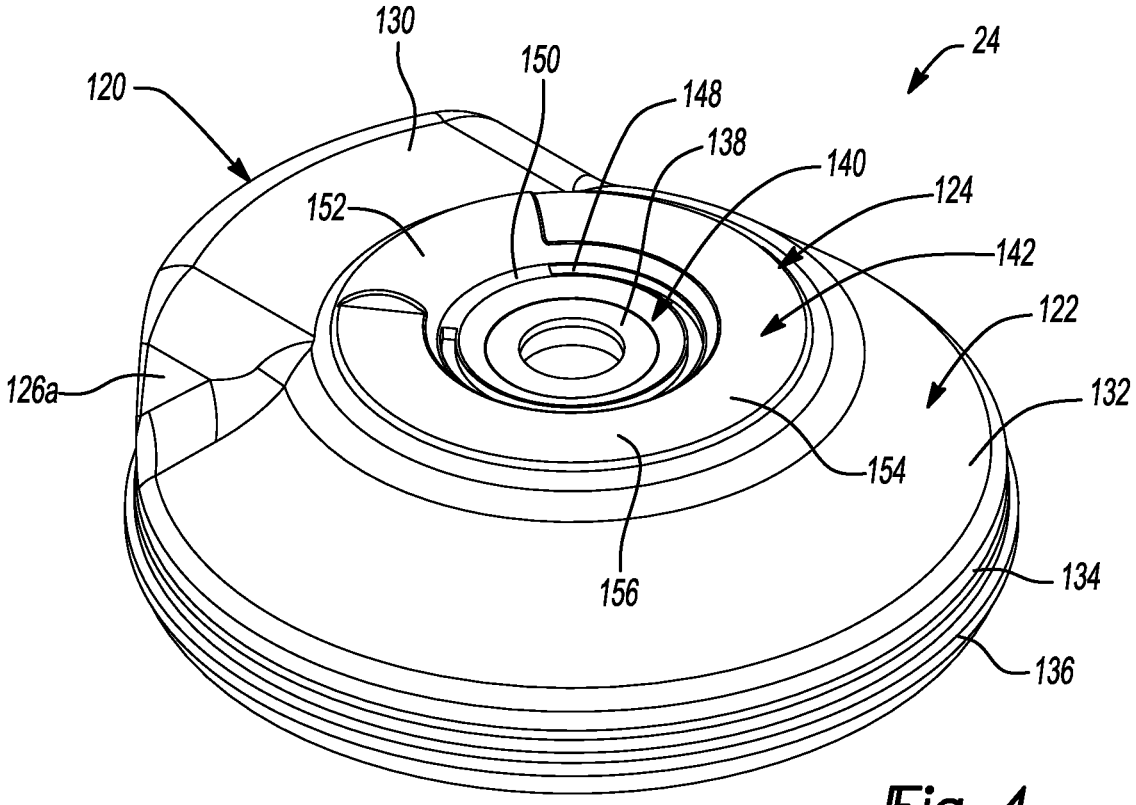
FIG. 4 is another perspective view of the muffler plate of FIG. 1.
Figure 5:
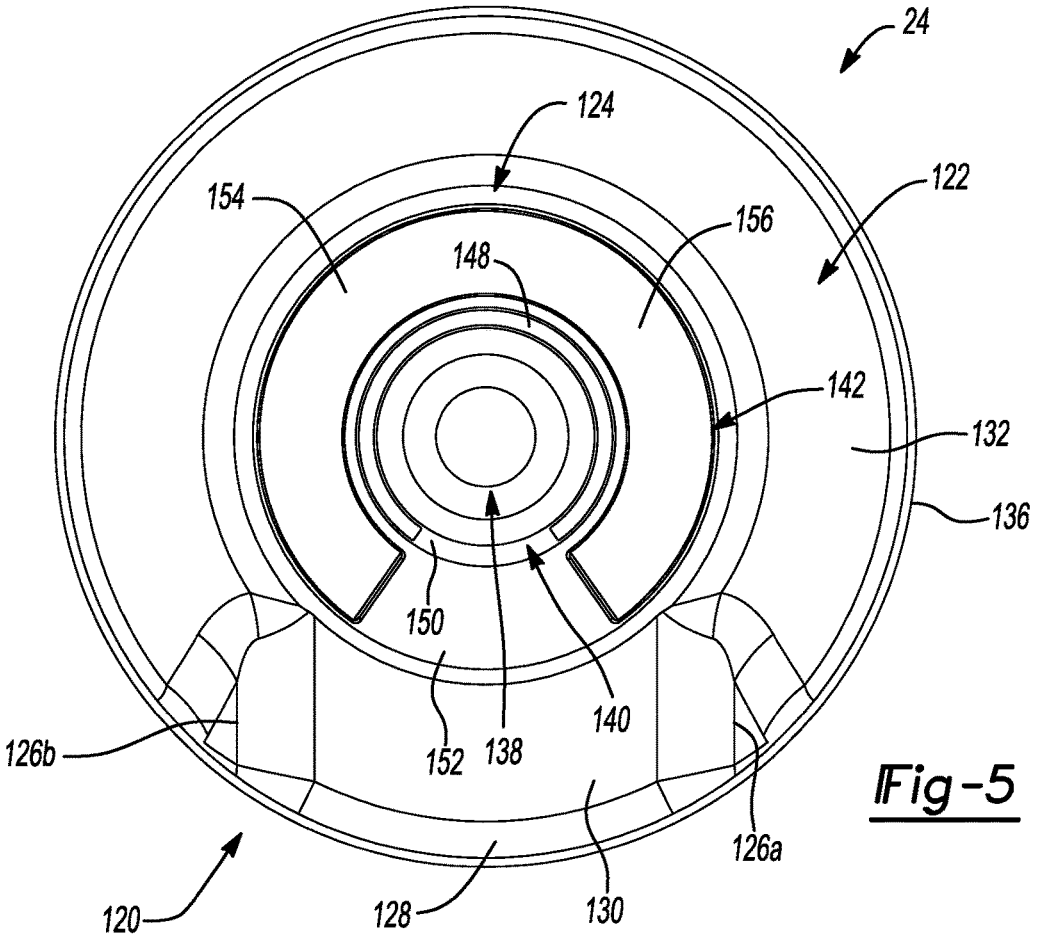
FIG. 5 is a top view of the muffler plate of FIG. 1.
Figure 6:
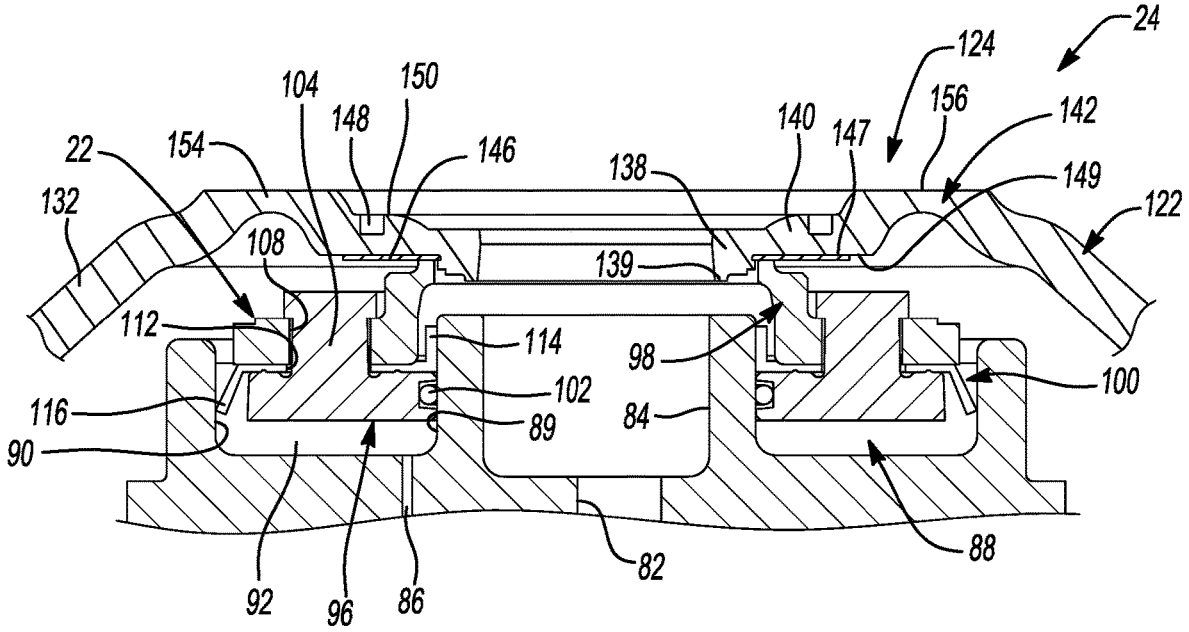
FIG. 6 is a cross-sectional view of the muffler plate of FIG. 1.

The hub 124 may include a circumferentially extending inner portion 138, a lip 139 (FIGS. 2, 6 and 7), a circumferentially extending intermediate portion 140 (FIGS. 3-5) and a circumferentially extending outer portion 142 (FIGS. 3-5). The inner portion 138 may define a discharge passage 144 extending therethrough to provide communication between the compression mechanism 20 and the discharge chamber 32. The muffler plate 24 includes a first side 141 facing away from the compression mechanism 20 and a second side 143 facing toward the compression mechanism 20. The first side 141 may include a first sloped portion 145 connecting the circumferentially extending outer portion 142 with the circumferentially extending intermediate portion 140. The first side 141 may also include a second sloped portion 151 connecting the circumferentially extending intermediate portion 140 with the circumferentially extending inner portion 138. The circumferentially-shaped lip 139 may extend downwardly in an axial direction from a lower surface of the inner portion 138 and may at least partially define the discharge passage 144. A wear ring 146 may be coupled (e.g., press-fitted) to the hub 124 and may surround the lip 139. A surface 147 of the wear ring 146 may contact a flat, lower surface 149 of the hub 124. The lip portion 110 of the first annular sealing member 98 sealingly engages the wear ring 146 thereby preventing fluid in the discharge chamber 32 from flowing into the suction chamber 94.

The intermediate portion 140 may be positioned between the inner portion 138 and the outer portion 142 and may include an arcuate slot 148 formed in a surface 150 thereof. The slot 148 is disposed radially between the first sloped portion 145 and second sloped portion 151. The slot 148 may extend around the intermediate portion 140 (e.g., the slot 148 may extend around the intermediate portion 140 between 250 and 320 degrees), and may be positioned radially outwardly relative to the point of engagement between the lip portion 110 and the wear ring 146. The point of engagement between the lip portion 110 and the wear ring 146 may be between the lip 139 of the hub 124 and the slot 148. The intermediate portion 140 may have a thickness that is greater than a thickness of the inner portion 138.

The outer portion 142 may include an arched section 152 and a non-arched section 154. The arched section 152 may be positioned between the outer walls 126*a*, 126*b* of the lobe 120 and may be adjacent to the upper wall 130 of the lobe 120. The arched section 152 may also be positioned between the upper wall 130 of the lobe 120 and a solid segment 155 of the circumferentially extending intermediate portion 140 that extends an entire width w of the circumferentially extending intermediate portion 140 and an entire thickness t of the circumferentially extending intermediate portion 140 (i.e., the segment of the circumferentially extending intermediate portion 140 that does not include the slot 148). The arched section 152 has a thickness greater than the thickness of the intermediate portion 140 and substantially equal to the thickness of the body portion 132 of the wedge 122.

The non-arched section 154 extends substantially around the circumferentially extending intermediate portion 140 (i.e., the non-arched section 154 may extend around the intermediate portion 140 between 275 and 345 degrees). The non-arched section 154 may include a flat upper surface 156 that is located a distance below an apex 158 of the arched section 152. The non-arched section 154 may be formed by removing material from an upper part of the outer portion 142.

With continued reference to FIGS. 1-7, operation of the compressor 10 will now be described in detail. During normal operation of the compressor 10, the muffler plate 24 is free of deformation and the lip portion 110 of the first annular sealing member 98 sealingly engages the wear ring 146 (i.e., sealingly engages 360 degrees around the wear ring 146) thereby preventing fluid in the discharge chamber 32 from flowing into the suction chamber 94.

When the compressor 10 operates at a high compression ratio ((discharge pressure/suction pressure) exceeds a predetermined threshold), the muffler plate 24 may undergo elastic deformation (i.e., the muffler plate 24 temporarily deforms and returns to its original shape when the compression ratio is below the predetermined threshold). That is, the hub 124 of the muffler plate 24 may temporarily deform downwardly (FIG. 7). The muffler plate 24 of the present disclosure allows the hub 124 to deform uniformly in the downward direction such that the lip portion 110 of the first annular sealing member 98 remains sealingly engaged with the wear ring 146 (sealingly engaged with the wear ring 146 360 degrees around the wear ring 146) thereby preventing the fluid in the discharge chamber 32 from flowing into the suction chamber 94.

One benefit of the compressor 10 of the present disclosure is that the muffler plate 24 allows elastic deformation of the hub 124 during high compression ratios to be uniform, which facilitates sealing between the first annular sealing member 98 and the wear ring 146, thereby continuing efficient and reliable operation of the compressor 10.

A compressor including a conventional muffler plate may experience non-uniform deformation at the hub when the compressor operates at high compression ratios. This may prevent proper sealing between the annular sealing member and the wear ring, which allows fluid from the discharge chamber to flow to the suction chamber.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell assembly having a suction chamber and a discharge chamber;

a muffler plate disposed within the shell assembly and separating the suction chamber from the discharge chamber, the muffler plate including a hub having a circumferentially extending inner portion, a circumferentially extending intermediate portion, and a circumferentially extending outer portion, the circumferentially extending intermediate portion disposed radially between the circumferentially extending inner portion and the circumferentially extending outer portion, the circumferentially extending inner portion defining a discharge passage extending therethrough and the circumferentially extending intermediate portion has a slot formed in a surface thereof, the slot extending only partially around the circumferentially extending intermediate portion; and a compression mechanism disposed within the suction chamber and providing working fluid to the discharge chamber via the discharge passage of the muffler plate, wherein the muffler plate includes a first side facing away from the compression mechanism and a second side facing toward the compression mechanism, wherein the first side includes a first sloped portion connecting the circumferentially extending outer portion with the circumferentially extending intermediate portion, wherein the first side includes a second sloped portion connecting the circumferentially extending intermediate portion with the circumferentially extending inner portion, and wherein the slot is disposed radially between the first sloped portion and second sloped portion.

2. The compressor of claim 1, wherein the slot extends around the circumferentially extending intermediate portion between 250 and 320 degrees.

3. The compressor of claim 1, wherein a thickness of the intermediate portion is greater than a thickness of the inner portion.

4. The compressor of claim 1, further comprising a sealing member surrounding the discharge passage and sealingly engaged with a wear ring of the muffler plate, the sealing member and the wear ring are sealingly engaged with each other at a location radially inwardly relative to the slot.

5. The compressor of claim 1, further comprising a sealing member surrounding the discharge passage and sealingly engaged with a wear ring of the muffler plate, the sealing member and the wear ring are sealingly engaged with each other at a location between the discharge passage and the slot.

6. The compressor of claim 5, wherein the hub includes a lip extending downwardly from the circumferentially extending inner portion and at least partially defining the discharge passage, and wherein the sealing member and the wear ring are sealingly engaged with each other at a location between the lip and the slot.

7. A compressor comprising:

a shell assembly having a suction chamber and a discharge chamber;

a muffler plate disposed within the shell assembly and separating the suction chamber from the discharge chamber, the muffler plate including a hub having a circumferentially extending intermediate portion and a circumferentially extending outer portion, the circumferentially extending outer portion includes an arched section and a non-arched section, the non-arched section extending only partially around the circumferentially extending intermediate portion, the arched section extending only partially around the circumferentially extending intermediate portion, wherein the non-arched section and the arched section are spaced apart from a cylindrical shell of the shell assembly; and a compression mechanism disposed within the suction chamber and providing working fluid to the discharge chamber via a discharge passage of muffler plate, wherein the arched section extends axially away from the non-arched section in an axial direction that extends away from the compression mechanism.

8. The compressor of claim 7, wherein the non-arched section extends around the circumferentially extending intermediate portion between 250 and 320 degrees.

9. The compressor of claim 7, wherein a thickness of the arched section is greater than a thickness of the circumferentially extending intermediate portion.

10. The compressor of claim 7, wherein the muffler plate includes a lobe extending from the circumferentially extending outer portion, and wherein the lobe has opposing outer walls and an upper wall.

11. The compressor of claim 10, wherein the arched section is positioned between the opposing outer walls.

12. The compressor of claim 10, wherein the upper wall is flat, and wherein the arched section is positioned adjacent the flat upper wall.

13. The compressor of claim 10, wherein a slot is formed in a surface of the circumferentially extending intermediate portion, the slot extending at least partially around the circumferentially extending intermediate portion.

14. The compressor of claim 13, wherein the arched section is positioned between the upper wall and a solid segment of the circumferentially extending intermediate portion that extends an entire width of the circumferentially extending intermediate portion and an entire thickness of the circumferentially extending intermediate portion.

15. The compressor of claim 7, wherein the non-arched section includes a planar upper surface.

16. The compressor of claim 7, wherein the non-arched section includes a flat upper surface that is located a distance below an apex of the arched section.

17. The compressor of claim 7, wherein the discharge passage extends through a circumferentially extending inner portion of the hub, and wherein the circumferentially extending intermediate portion is positioned between the circumferentially extending inner portion and the circumferentially extending outer portion.

18. A compressor comprising:

a shell assembly having a suction chamber and a discharge chamber;

a muffler plate disposed within the shell assembly and separating the suction chamber from the discharge chamber, the muffler plate including:

a hub including an intermediate portion, an inner portion, and an outer portion, the intermediate portion disposed radially between the inner portion and the outer portion, the intermediate portion having a thickness that is greater than a thickness of the inner portion, a first section of the outer portion having a thickness that is greater than the thickness of the intermediate portion, and a second section of the outer portion having a thickness that is less than the thickness of the intermediate portion; and a lobe extending from the outer portion and including a planar wall spaced apart from the shell assembly and having a thickness that is equal to the thickness of the first section of the outer portion; and a compression mechanism disposed within the suction chamber and providing working fluid to the discharge chamber via a discharge passage extending through the inner portion of the hub, wherein the first section of the outer portion of the hub is an arched section and the second section of the outer portion of the hub is a non-arched section.

19. A compressor comprising:

a shell assembly having a suction chamber and a discharge chamber;

a muffler plate disposed within the shell assembly and separating the suction chamber from the discharge chamber, the muffler plate including:

a hub including an intermediate portion, an inner portion, and an outer portion, the intermediate portion disposed radially between the inner portion and the outer portion, the intermediate portion having a thickness that is greater than a thickness of the inner portion, a first section of the outer portion having a thickness that is greater than the thickness of the intermediate portion, and a second section of the outer portion having a thickness that is less than the thickness of the intermediate portion; and a lobe extending from the outer portion and including a planar wall spaced apart from the shell assembly and having a thickness that is equal to the thickness of the first section of the outer portion; and a compression mechanism disposed within the suction chamber and providing working fluid to the discharge chamber via a discharge passage extending through the inner portion of the hub, wherein the hub of the muffler plate includes a slot formed in the intermediate portion, wherein the slot extends at least partially around the intermediate portion.

20. The compressor of claim 19, wherein the first section of the outer portion of the hub is an arched section and the second section of the outer portion of the hub is a non-arched section.

* * * * *